United States Patent [19]

Bode

[11] Patent Number: 5,004,048

[45] Date of Patent: Apr. 2, 1991

[54] APPARATUS FOR INJECTING DISPLACEMENT PLUGS

[76] Inventor: Robert E. Bode, 14911 Wunderlich, Apt. #1903, Houston, Tex. 77069

[21] Appl. No.: 437,458

[22] Filed: Nov. 15, 1989

[51] Int. Cl.[5] ..... E21B 33/16

[52] U.S. Cl. ..... 166/70; 166/66.5; 166/113; 166/156; 15/104.062; 137/268

[58] Field of Search ..... 166/70, 75.1, 327, 326, 166/325, 153, 155, 156; 15/104.062; 137/268

[56] References Cited

U.S. PATENT DOCUMENTS

| | | | |
|---|---|---|---|
| 2,008,818 | 7/1935 | Corbett | 166/327 |
| 2,919,709 | 1/1960 | Schwegman | 166/325 X |
| 2,977,617 | 4/1961 | Willis | 15/104.062 |
| 3,000,028 | 9/1961 | Buie et al. | 15/104.062 |
| 3,028,996 | 4/1962 | Ellett | 15/104.062 |
| 3,089,551 | 5/1963 | Greene | 166/327 X |
| 3,291,217 | 12/1966 | Wakefield, Jr. | 166/70 X |
| 3,616,850 | 11/1971 | Scott | 166/155 |
| 3,779,270 | 12/1973 | Davis | 15/104.062 X |
| 4,047,566 | 9/1977 | Duke | 166/155 X |

*Primary Examiner*—Stephen J. Novosad

[57] ABSTRACT

A displacement plug injection apparatus and manifold for sequentially injecting cementing plugs into the casing in an oil or gas well to reduce contamination of the interface between the well fluid and the cement, which apparatus includes an injection manifold for injecting pick-up balls into the fluid stream which pass through an inlet port in the casing to selectively pick-up cement displacement plugs in a plug set which are suspended or held in place with in the casing to be cemented. A positive mechanical indication of the injection of each pick-up ball is apparent and in adition a secondary magnetic sensor indicates a passage of a pick-up ball into the throat provided above the set of displacement plugs to indicate the beginning of the launch of each plug in the plug set. Also disclosed is a new and improved check valve apparatus for use in float collars and cementing shoes used in casing cementing operations.

6 Claims, 3 Drawing Sheets

APPARATUS FOR INJECTING DISPLACEMENT PLUGS

BACKGROUND OF THE INVENTION

This invention relates to the cementing of casing in oil and gas wells by the use of cementing plugs. More specifically, this invention relates to a new and improved plug launching system and surface injection manifold. The cementing plug injection system is designed to selectively release one or more plugs into the well casing ahead of or behind a cement slurry to reduce contamination of the cement. A first cementing plug may optionally be used ahead of an optional chemical spacer fluid, which can further insure a minimum amount of chemical interference with a cement slurry and a minimal amount of contamination. This optional first plug and spacer fluid would then be followed by a second plug which wipes the drilling fluid from the walls of the casing ahead of the cement slurry, which second cementing plug is then followed by a cementing top plug on command. The top plug follows the cement and further prevents contamination or channeling of the cement with the drilling fluid or fluid used to displace the cement.

The new and improved apparatus of the present invention selectively injects at desired intervals at one or more cementing plugs from an assembly which provides a mandrel and may utilize a slip joint which may be suspended inside the casing at any desired location or depth, which mandrel is fitted with one or more cementing plugs which are releasably retained upon the mandrel by shear rings of different capacities, or are held in position above a restriction sleeve. An injection manifold up stream of the mandrel and plug assembly, which can be skid mounted, is provided with an assembly of injection cylinders fitted with spring loaded pistons, which can be loaded or dressed with pick-up balls, which in turn each are held in a loaded position by a second set of air cylinders each fitted with a spring loaded piston, which in the loaded position extends to retain a pick-up ball within the first cylinder set. One ball launcher and pick-up ball is sized and used for each cement plug mounted to the mandrel. Each cement plug is provided with an interior passage, and at or near the lower most end of each cement plug is a landing ring sized for a pick-up ball of a particular diameter. Pick-up balls for the lower cement plugs are slightly smaller in diameter than pick-up balls for upper cement plugs. The plugs are launched by sequentially injecting the pick-up balls, the smaller ones first, into the stream of cement of slurry, or into the drilling fluid stream. The pick-up ball is carried to its landing in a particular cement plug and pressure build up shears a shear ring holding that cement plug to the mandrel combination assembly (or optionally forces one plug past a restriction sleeve), and the cement plug is thereby launched for the purposes as described above. The method and apparatus of the present invention is further provided with both a fail-safe positive mechanical indication for the launching of each pick-up ball, and with a further magnetic pick-up indication of launching for each of the pick-up balls, to provide positive indication when a plug or plugs have been launched. The method and apparatus of the present invention provides a highly adaptable, efficient and inexpensive means of injecting one or more cementing plugs which can be used on any diameter casing, and further can be used for both surface plug launching or subsea plug launching.

The use of cementing plugs in oil and gas well cementing operations has long been known. The prior art operation is best described in U.S. Pat. No. 4,427,065 to James S. Watson. Watson discloses a cylindrical cementing plug container assembly which is loaded with one or more cementing plugs stacked vertically one above the other. This entire cementing plug container housing is mounted above the casing. Each plug is held within its housing by a mechanical cam lock holding-/release device. The cam lock release devices are separately remotely actuateable, and when actuated each device will move the plug holder out of the plugs path where upon each plug is pulled/pushed by a combination of fluid flow, vortex action and gravity into the vortex fluid stream where it is caught by the moving fluid and pumped downhole. The cumbersome Watson cementing plug container, which in the usual practice contains two cementing plugs, projects a significant distance above the casing, and thereby necessitates much longer elevator bails than would be required without the cementing plug container assembly. Furthermore, if it is desired to provide more than two cementing plugs, either a separate plug container in a longer length projecting even further above the casing must be fabricated, or some means of connecting a series of the cementing plug containers which utilize twin displacement cementing plugs must be fashioned. If this is not done, Watson provides no significant safety over the earlier method (also described in U.S. Pat. No. 4,427,065) of removing and replacing the dome each time a plug is inserted with the consequent expenditure of time, expense, and creation of hazardous working conditions. In addition, each of the various casing sizes requires a different Watson cementing plug container housing assembly.

The new and improved method and apparatus for injecting displacement cementing plugs disclosed in the present invention remedies all of the short fallings of the prior art devices, and provides method and apparatus for injecting one or more displacement plugs which is readily adaptable to all casing sizes, which can be used either sub-sea or at surface locations, and which provides a simple and efficient skid mounted injection header assembly which provides positive physical evidence directly related to the launching of each displacement plug in the series. Also disclosed in the primary embodiment are a new and improved cement shoe and plug collar which each alone are significant improvements over prior art devices.

BRIEF DESCRIPTION OF THE DRAWINGS

The present invention has other objects, features and advantages which will become more clearly apparent in connection with the following detailed description of the preferred embodiments, taken in conjunction with the appended drawings, in which.

DETAILED DESCRIPTION OF THE PREFERRED EMBODIMENTS

Figure 1:
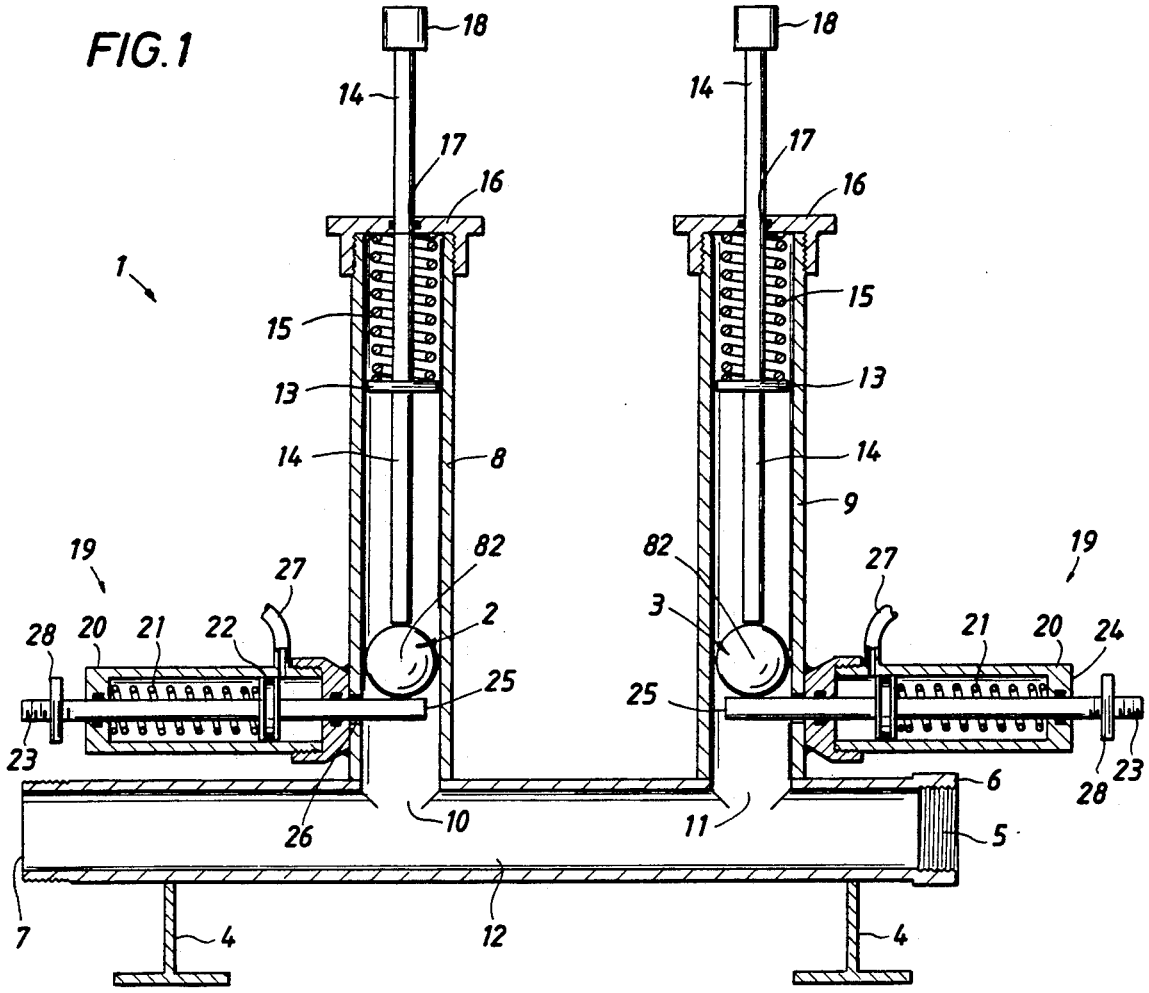
FIG. 1 is a cross-section through the surface injection manifold of invention.

With reference to FIG. 1, and indicated generally by the numeral 1 is a surface injection manifold equipped for launching two pick-up balls 2 and 3. Although the illustrated injection manifold is only equipped for launching two pick-up balls, it should be understood that provision for as many pick-up balls, corresponding to as many displacement plugs as desired, can be provided. The surface injection manifold 1 may be skid mounted on a frame 4 which will be placed on the rig floor (not shown). The inlet end 5 of the injection manifold can be provided with connection means such as the illustrated threaded connection means 6 for connection to a single chicksan (or high pressure hose) to a cement hopper or manifold (not shown). The opposite end 7 or exit will be connected to the inlet 35 of the casing or sub sea launching system by a high pressure hose (not shown).

The pick-up balls 2 and 3 are placed within a bore provided in respective housings 8 and 9, each of which has an opening 10 and 11 respectively from the housing bore into the main interior flow passage 12 of the injection manifold.

Each of the housings 8 and 9 is provided with a piston head 13 positioned within the interior bore of each of the housings 8 and 9. Each piston head is provided with a piston rod 14 which extends from the piston in both directions along and through the housing bore, and which in the illustrated loaded position, extends downward to rest against the upper surface of each of the pick-up balls 2 and 3 and extends upwardly through the center of a coiled actuator spring 15, which in the illustrated loaded position is compressed, and the piston stem 14 further extends upward and projects beyond the upper portion of each of the housings 8 and 9. In general a spring capable of applying 50 psi should be sufficient to launch the pick-up balls, but much higher capabilities are possible. It may also be desirable to provide sealing means around the pistons and to provide hydraulic inlets and connections into the bores of the launch housings 8 and 9 above the piston plunges heads 13 so that the rig pump hydraulics can be applied to force the piston stems 14 down and inject the pick-up balls. Hydraulic pressures of 3000 psi to 5000 psi are thus available for injecting the pick-up balls. Each housing is provided with a threaded cap 16, threadedly attached to threads provided at the exterior of each of the housings 8 and 9. Each threaded cap is provided with a central aperture 17 through which the upwardly projecting portion of the piston stem 14 passes. A threaded stop 18 is attached to the extreme upward end of each the piston stems 14 so that even in the released position with springs 15 fully extended as will be described below, the upper portion of the stem 14 will not pass completely through the caps 16.

Each of the illustrated piston housings 8 and 9 is further provided with a releasable retaining apparatus illustrated generally by the numerals 19 for retaining the two pick-up balls 2 and 3 within their respective piston housings 8 and 9. In the illustrated loaded or dressed position, each retaining apparatus provides an air cylinder housing 20 which is fitted in a similar manner to the cylinder housings 8 and 9 with an interior compression spring 21, which in the loaded or dressed position will be extended. Each retaining apparatus 19 provides a central rod 23 which passes through the cap end of the air cylinder 24, extends through the center of the compression spring 21, further extends through the center of piston plunger heads 22, and then extends through the opposite end of the air cylinders from the cap 24 into the interiors of the cylinders 8 and 9 at a position closely adjacent the apertures 10 and 11 of the respective piston housings 8 and 9 into the interior 12 of the cement injection manifold. In the illustrated position with the compressible springs 21 fully extended as is the case when cylinders 8 and 9 are to be loaded or dressed, the projecting or stop end 25 of the central rods 23 projects through apertures 26 within the housings 8 and 9 in such a manner as to prevent passage of any pick-up ball such as 2 or 3 through apertures 10 or 11 into the main interior passage 12 of the injection manifold 12. Each of the retaining apparatuses 19 is provided with an air inlet means 27 and connection means upon the air inlet means , which provide for introducing air under pressure into the cylinder on the side of the plunger opposite the springs 21, so that as the pressure is increased, the springs 21 will be compressed by the air pressure, which causes the projecting stop ends 25 of the central rods 23 to be withdrawn from the interiors of the housings 8 and 9, and thereby selectively permit the passage of pick-up balls 2 and 3 in desired and timed sequence. The retaining apparatus 19 is further provided at the opposite end of the central rod 23 from the stop end 25 with a cap means 28 to prevent the passage of rod 23 completely through the cap end 24 of the cylinder. In addition, other suitable means such as a threaded means affixed to the housings 20 may be optionally provided to positively lock the central rod 23 in its dressed or loaded position and to mechanically prevent the retraction of the projecting ends 25 until the mechanical lock had been released.

Figure 2:
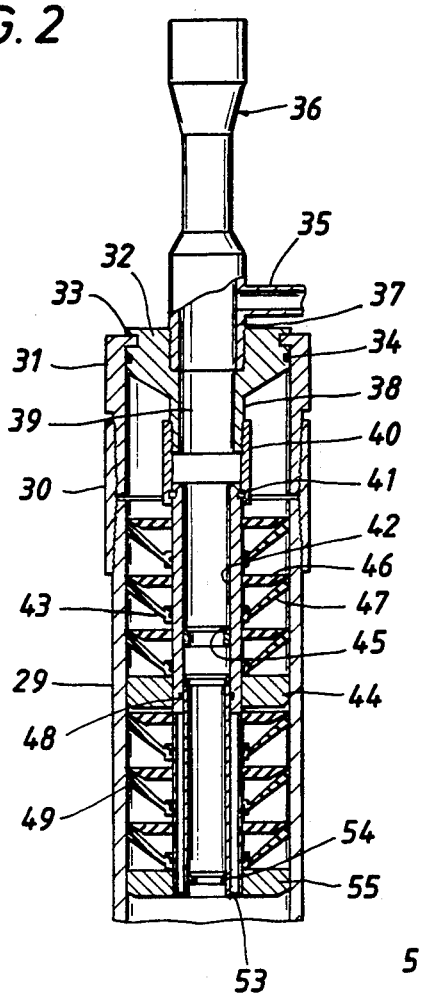
FIG. 2 a cross-section through an embodiment of the mandrel mounted displacement plug launching system suspended at or near the surface opening of the casing.

Referring now to FIG. 2, there is illustrated in cross-section a launching system adapted to be suspended near the surface opening of casing to be cemented As was previously mentioned, one of the advantages of the present method and apparatus is that there is no requirement for a housing extending and projecting up above the casing. Another advantage mentioned is that the present method and apparatus can simply and quickly be adapted for use with casing of any size. As illustrated in the cross-section of FIG. 2 the casing 29 projects at least slightly above the surface. A standard casing coupling 30 is affixed to the upper portion of the casing into the casing coupler 30 has fitted a casing adaptor 31, which can be of configured to adapt to any desired size of casing. At the upper portion of the casing adaptor 31 is an inner adaptor ring 32 of standard size which is fitted to the adaptor by an adaptor lock nut 33 which is threadedly attached to the upper portion of the casing adaptor ring and screws down to tighten against the casing adaptor 21, and thereby fixedly mount the inner adaptor ring and casing adaptor into a unit. Also illustrated is a resilient seal, which for example can be an o-ring seal or a poly-pack seal, 34 are thus provided variously about the apparatus which in operation is subjected to fluid pressure, as will be described in more detail below. Further apparatus attached above inner adaptor ring 32 comprises an inlet means 35 which is attached by suitable means to the outlet 7 of the injection manifold of FIG. 1. Above the inlet from the injection manifold there is illustrated a handling sub 36 for pick up and make up of the drill pipe. Immediately below the inlet 35 there is provided a magnetic sensor 37, the purposes of which will be described in more detail below.

The inner adaptor ring 32 comprises an upper cylindrical portion, an intermediate conical portion tapering inwardly, and a lower tubular nose 38 to which is mounted the remaining encasing of the present invention. An interior passage 39 connects the inlet 35, and injection manifold interior 12, and any attached cement manifold (not shown) with the interior of the inner adaptor ring 39. A mandrel adaptor 40 may be threadedly attached to the tubular nose 38 of the inner adaptor. An upper shear ring 41 retains the top plug mandrel 42 of a top plug indicated generally by the numeral 43 in both FIG'S. 2 and 4.

At this point it should be interposed that although the method and apparatus of the present invention can be utilized with conventional cement displacement plugs, the primary embodiment would utilize the new and improved cement displacement plugs described in pending patent application Ser. No. 07/339,483, now abandoned, of which the inventor the present application is a co-inventor. Application Ser. No. 07/339,483, now abandoned, is hereby fully incorporated by reference for all purposes.

Other features of the top plug 43 illustrated in FIG'S. 2 and 4 are as follows, the upper stabilizer and drive plate 44, the upper ball stop 45, and the upper and lower wiper wings 46 and 47 respectively, which are provided in multiples as illustrated and as described in the referenced co-pending application.

Figure 5:
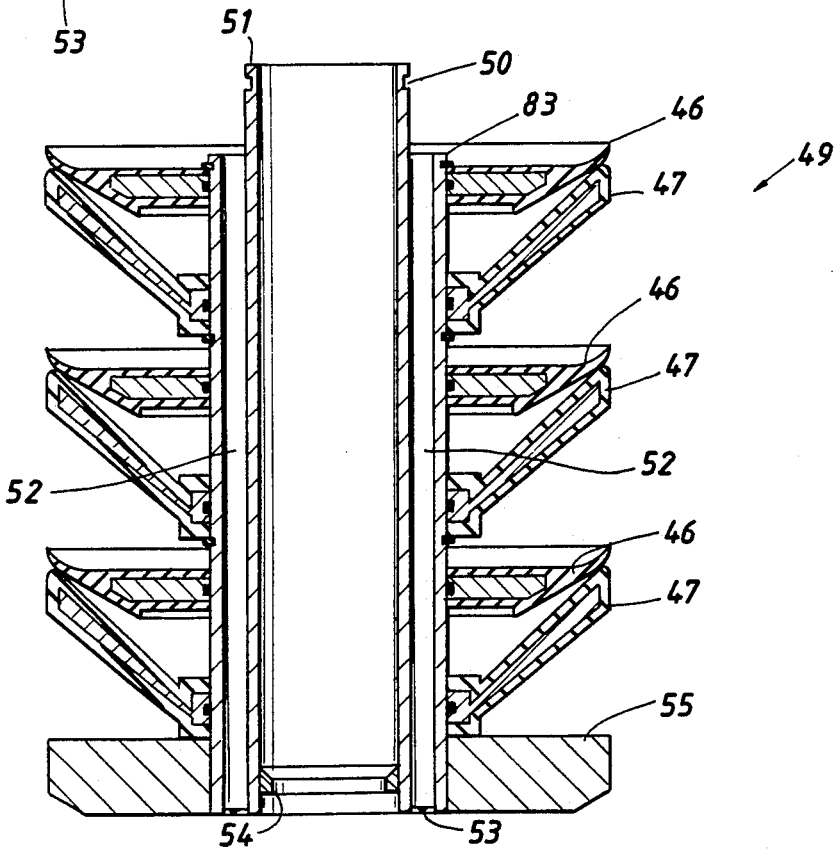
FIG. 5 is a cross-section through a bottom displacement plug.

Affixed by a lower shear ring 48 to the lower portion of the upper displacement plug 43 is the bottom plug 49, which is illustrated in greater detail in FIG. 5. The lower shear ring 48 is mounted within a shear ring cavity 50 near the upper portion of the bottom plug mandrel 51. FIG. 5. Circulation ports 52 are provided along the sides of the bottom plug mandrel 51, and are sealed at the lower end by rupture disc 53. A lower ball seat 54 is located near the lower end of the bottom plug 49. A centralizer or stabilizer 55 is also provided for the bottom plug, as are multiple sets of upper and lower wiper wings 46 and 47 respectively.

Figure 3:
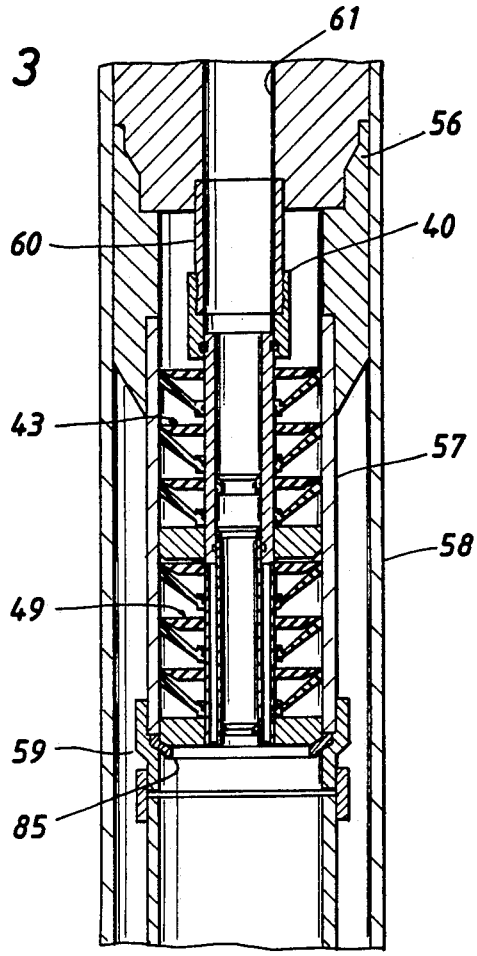
FIG. 3 is cross-section through an alternative embodiment for sub sea launch.

Referring now to FIG. 3, there is illustrated in cross-section, a variant embodiment of the method and apparatus of the present invention configured for a sub sea launch, using a casing hanger 56, which is supporting the casing to be cemented 57 within an outer casing 58, which has already been cemented. A restriction sleeve 59 is provided for landing and locating the interconnected displacement plugs of the present invention. Although a variety of restriction subs or restriction sleeves are suitable, the primary embodiment envisioned for the present method and apparatus is the improved restriction sub described in the co-pending patent application Ser. No. 07/266,266, now U.S. Pat. No. 4,907,649, for the which the present applicant is the sole inventor. Application Ser. No. 07/266,266, now U.S. Pat. No. 4,907,649, is hereby fully incorporated by reference for all purposes.

The connected series of upper 43 and lower 49 restriction plugs, and the mandrel adaptor 40 for the sub sea embodiment of FIG. 3 are identical to the surface embodiment of FIG. 2. An adapting running mandrel 60 connects the apparatus described for the embodiment of FIG. 3 with the running tubing or casing 61 to be utilized for the sub sea launch.

Figure 8:
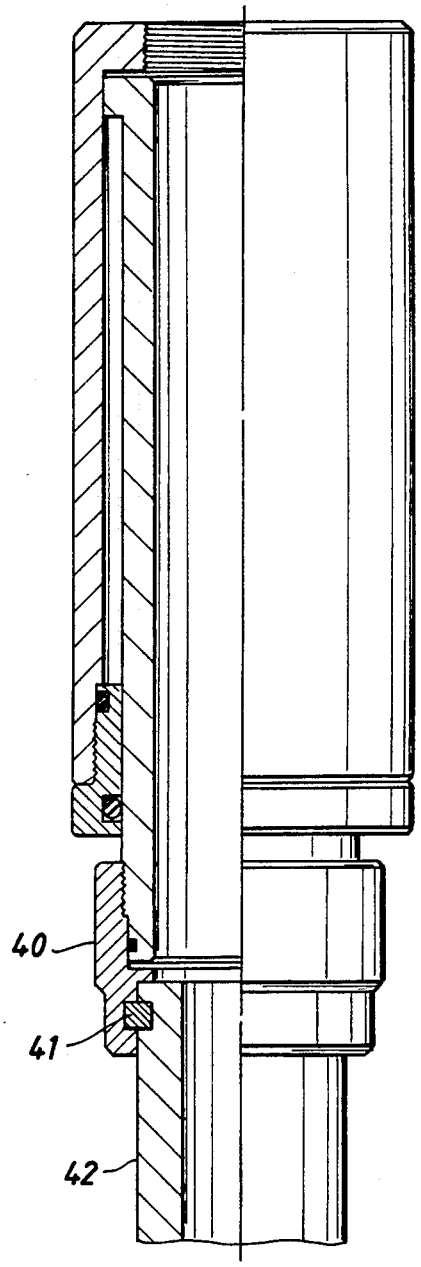
FIG. 8 is an elevation/partial cross section of a slip-joint for use in multiple plug applications.

An alternative embodiment will not connect adjacent plugs in a set with lock rings, but will position them within an aligned string upon a slip joint as illustrated in FIG. 8. Only the upper plug mandrel 42 is connected by a shear ring 41, and the lower plug or plugs rest or land in a restriction sleave 85 as illustrated in FIG. 3 and as described in application Ser. No. 07/266,266, now U.S. Pat. No. 4,907,649, hereby fully incorporated by reference.

Figure 6:
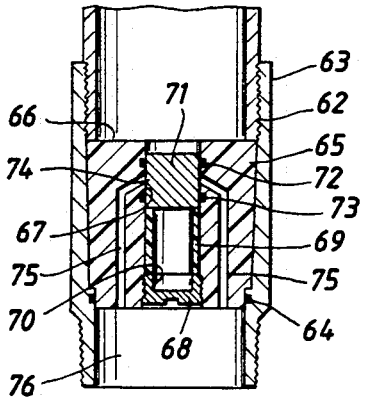
FIG. 6 is a cross-section through a new and improved float collar.
Figure 7:
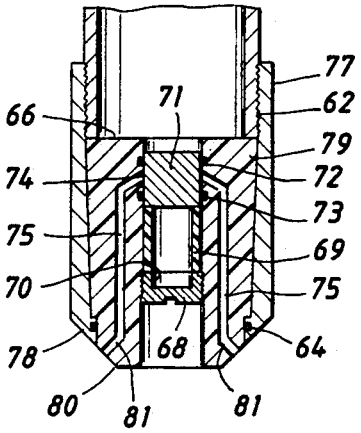
FIG. 7 is a cross-section through a new and improved cementing shoe.

Referring now to FIG'S. 6 and 7, illustrated in FIG. 6 is a cross section through a new and improved float collar, and in FIG. 7 there is illustrated a new and improved cement casing shoe. Although the previously described apparatus of the present invention can be used with conventional float collars and casing shoes, the anticipated primary embodiment would utilize the illustrated new and improved shoe and float collar. Referring now to FIG. 6, the reference numeral 62 represents an upper casing to which the body 63 of the flow collar is threadedly attached. The upper portion of the body 63 may be cut with threads for attachment to standard casing. The portion of the body 63 which lies below the upper casing 62 is cut with a conical taper narrowing in the downward direction. A resilient seal 64 is positioned as illustrated near the lower of the body 63. A plastic insert 65 is molded or formed to seat into the taper provided within the interior of the body 63. The lower portion of the plastic insert 65 compresses the resilient seal 64 about the circumference within in the lower portion of the body 63. The plastic insert 65 is further retained and seated within the bottom of the taper by the upper casing, which when threaded into the upper portion of the body 63 will abut the top surface 66 of the plastic insert 65. Plastic insert 65 is provided with a cylindrical bore 67 which is provided with resilient seals 72 and 73, which are located above and below apertures 74 into flow areas 75 with the plastic insert 65 and which is closed off and sealed at its lower portion by a retainer plug 68 threadedly inserted into and thereby sealing the bore 67. The threaded retainer plug 68 is itself provided with a cylindrical concavity 70 of smaller diameter than the central cylindrical bore 67 into which is fitted a resilient non-metallic spring 69 atop which is positioned a piston 71. As is illustrated in FIG'S. 6 and 7 in its natural non-compressed state, the non-metallic spring 69 will hold the piston 71 in a position to close off the apertures 74 and flow area 75 and the seals 72 and 73 will prevent any fluid under pressure from entering the flow areas, and thereby passing through the flow area 75 into the lower portion of the flow collar 76.

Referring now to FIG. 7, there is illustrated a new and improved cementing casing shoe, which shows the characteristics, and can be made of components that are interchangeable with those just described for the flow collar. A difference, however, is illustrated in the configuration of the shoe body 77, which is formed at its lower extremity 78 to provide a angled or rounded nose cone appearance. The plastic insert 79 utilized with the cementing casing shoe of FIG. 7 at its lower end 80 is formed to continue the rounded or angled nose cone section of the cementing shoe, and in addition, the flow areas 75 are angled as at 81 to enhance jetting action while circulating in a string of casing, due to a tight hole. The remaining interior components of the cementing shoe comprising the threaded retainer plug 68, the non-metallic spring 69, the piston 71, and seals 72 and 73 are as described the flow collar of FIG. 6, and therefore are illustrated with like referenced numerals.

The float collar is designed to withstand the loading applied while pressure testing the casing string after displacing cement in the casing. It will be fabricated from high tensile plastic, and it is tapered to land out in a tapered housing to improve loading characteristics. The prior art ball check has been replaced with a sliding piston opened by pressure and closed by a rubber spring located below the piston. When pressure is applied the piston moves down below the bypass ports by compressing the resilient rubber string, and allows fluid to bypass the piston. When the pump is stopped, the piston is returned to a closed position by the resilience of the spring, giving a positive closure. The old style ball check system often leaked, due to large particles lodging between the ball and the seat. The float shoe illustrated in FIG. 7 is designed on a similar concept as the float collar with the exception of having bypass ports angling outward at the shoe nose, to enhance jetting action while circulating in a string of casing, due to a tight hold.

DESCRIPTION OF THE OPERATION OF THE PREFERRED EMBODIMENT

The surface injection manifold 1 of FIG. 1 is mounted on a frame 4 and placed on the rig floor (not shown). The inlet end 5 of the manifold is connected to a cement manifold (not shown). The opposite end 7, or exit of the injection manifold 1 will be connected by a high pressure hose (not shown) to the inlet of the casing 35 (FIG. 2), or sub sea launching system. To dress or load the injection manifold, the threaded caps 16 are each removed in turn from the left and right housings 8 and 9 respectively. Pick-up balls 2 and 3 will be placed in the prospective ball housings 8 and 9. The pick up ball utilized with the bottom plug 49 is slightly smaller than the top pick-up plug ball 3 used in the top plug 43. The pick-up balls 2 and 3 rest on top of the projecting or stop end of the central rods 23 of the releasable retaining apparatuses 19, which are held in the projecting position by the springs 21 within each of the air cylinders 20, and which can further be mechanically latched in position by threaded stop means. The top unions or threaded caps 16 are installed and tightened, and the injection manifold 1 is dressed or loaded. The series of upper and lower plugs 43, 49 et. seq. as many as are desired, are installed in the casing, either at the top of the casing as depicted in FIG. 2 by threadedly inserting a casing adaptor 31 into the top of the casing, or into the casing coupling 30, and then next lowering a string of upper and lower displacement plugs 43 and 49, which have been assembled as described in the related patent application Ser. No. 07/339,483, now abandoned. This string of displacement plugs fixed into an in-line unit by plastic shear rings is in turned fixed to a mandrel adaptor 40 by an upper shear ring 41, and the mandrel adaptor is installed onto the inner adaptor ring 32 by means such as a threaded connection. The handling sub 36 is likewise installed at the opposite end of the inner adaptor ring 32, and the assembly of handling sub, inner adaptor, ring mandrel, adaptor and the series of displacement plugs is then lowered into the casing. A lock nut 33 locks the adaptor rigidly into place at the top of the casing adaptor 31. It is apparent that this configuration is adaptable to a wide variety of casing sizes by merely providing casing adapters 31 to fit the different casing sizes.

In operation, to cement a well casing in a well bore, the well will be conditioned by circulating an appropriate fluid down the casing and up through annulus outside the casing, and back up to the surface. The top and bottom plugs which have been located within the casing at the surface as in FIG. 2, or sub sea by resting against a restriction sub as in FIG. 3, are retained in that position during the conditioning step.

The pick-up balls 2 and 3 are launched by applying air from a rigs source to each of the air cylinders 20 through the air inlet means 22 in turn. If a mechanical latching means is provided, that must first be released, and then the application of air pressure to the air inlet means 27 will retract the cylinder piston rods 23 by action of air pressure against the pistons 22, thus causing the spring 21 to compress, and causing the projecting end or stop end 25 of the central rod to be pulled from the interior of housings 8 or 9, depending upon which cylinder 20 has been pressurized. Upon the retraction of the projecting rod end 25 the compression energy stored in the springs 15 are of the upright cylinders 8 and 9 against the pistons 13 will force the rods 14 downward, thereby moving either ball 2 or 3 through apertures 10 or 11, and into the stream or flow area 12 of the manifold, and consequently through the hose down the launching mandrels to come to rest either in seat 54 or 45 as intended. The application of a selected pressure will first shear the lower shearing 48, and thereby allow the lower displacement plug to be forced through the casing. The sequence is repeated by applying air pressure to the second cylinder, causing rod 25 to withdraw, causing rod 14 to force ball 3 into the flow area 12, whereupon it eventually comes to rest in the upper ball seat 45, whereupon an increase in pressure will shear the upper shear ring 41, release the upper displacement plug 43.

A magnetic indicator can be placed in the manifold down stream from the balls to excite a light once the ball is passed the sensor. This magnetic indicator is indicated in FIG. 2 by numeral 37. A small pencil magnetic can be implanted in the balls as indicated by numeral 82 in FIG. 1. This magnetic indicator provides a clear indication that the ball has passed into the throat of the plug mandrels, and is a positive second indication of the proper launching of the pick-up balls in addition to that provided by the physical indication of each piston stem 14 being in the fully extended launch position so that only the cap 18 shows above each cap 16 after launch.

Although the assembly and operation related the improved displacement plugs has been thoroughly described and detailed in the referenced patent application Ser. No. 07/339,483, now abandoned, a procedure will be quickly sketched here as part of the description of the method of use and operation of the present invention.

Figure 4:
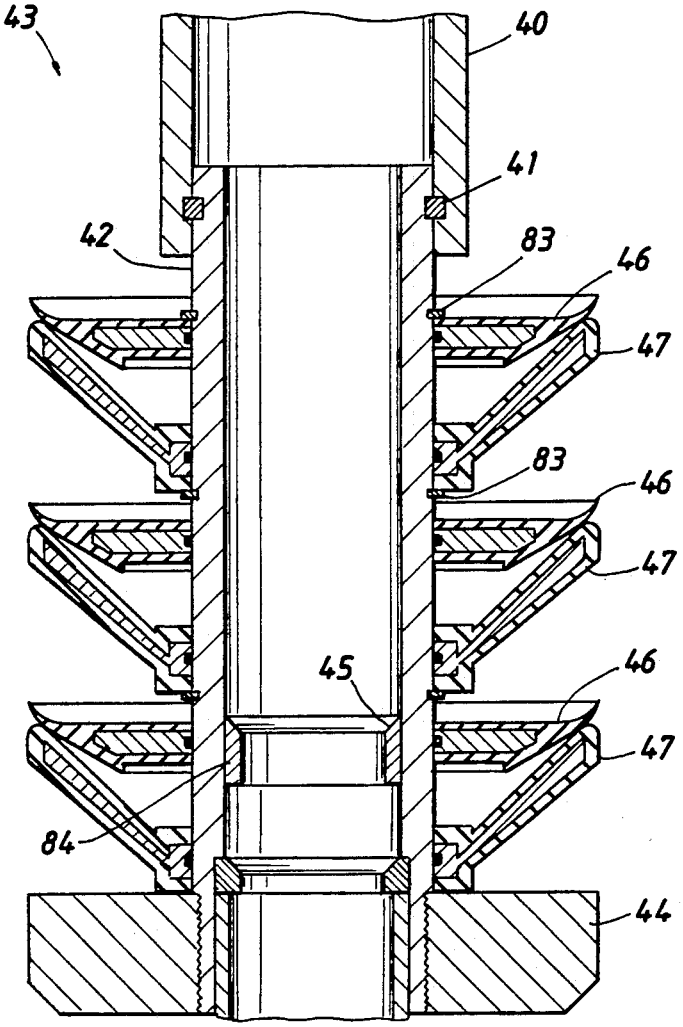
FIG. 4 is a cross-section through a top displacement plug.

On the top plug mandrel an upper top ring 83 is installed as in FIG. 4. Next, the first set of upper and lower flex wings 46 and 47 respectively is installed whereupon a second stop ring 83 is installed below the first set of rings. Succeeding sets of flex rings 46 and 43, and succeeding stop rings 83 are installed as desired. The stabilizer 44 is next installed, as is the ball landing ring which is installed through the top of the top plug mandrel until it lands out on a shoulder provided for that purpose on the interior of the top plug mandrel 42.

The bottom plug mandrel assembly is next assembled, by installing an upper stop ring 83 as at FIG. 5, followed by upper and lower flex wings 46 and 47, and further stop rings 83 in series in a similar manner to that for the top plug. The bottom plug stabilizer and internal ball seats are next installed, and a rubber rupture disc is exposed to cover ports of the bottom plug mandrel. Now that the individual top and bottom plugs are dressed, the bottom plug is attached to the top plug by inserting the upper portion of the bottom plug mandrel into the lower portion of the top plug mandrel, whereupon raw plastic is injected into a port into a shearing cavity as illustrated at 50 in FIG. 5, and FIG. 2. The raw plastic is injected and ages with time and temperature to become shear ring 48. In a similar manner the upper portion of the top plug is inserted into the lower portion of the mandrel adaptor 40, and raw plastic is injected into a port to form the upper shear ring 41. The two plugs and adaptor mandrel are now fully dressed, and become a plug set as the raw plastic ages with time and temperature.

In the optional embodiment which utilizes a restriction sleeve 85 as illustrated in FIG. 3, it is not necessary to lock the top and bottom plugs together as the bottom plug lands or rests on the restriction sleeve.

Assuming the tools are to be run conventionally, that is with the casing extending to the surface, the first step is to pick up the handling sub 36 and make that up to the inner adaptor ring 32. The next step is to fit the casing adaptor 31 to the inner adaptor ring 32, and to tighten the adaptor lock nut 33. Following that, the mandrel adaptor is screwed with the plug set to the inner adaptor ring. The plug set assembly is positioned into a casing pump collar, and the casing is made up to the casing collar.

In the optional embodiment, the make up procedure is similar except that the plug set assembly is screwed into a casing pump of an exact length, so that the bottom plug will land out on a restriction sleeve located in the indicator plug. The bottom plug is not attached to the upper plug in this case. This optional embodiment can also use the slip joint of FIG. 8 for applications using more than two displacement plugs.

The surface injection manifold is then placed in position on a rig floor, and the caps on both housings are removed as balls are installed in their respective housing to come to rest against a releasable retaining means connected to the air cylinders. The top caps are both installed, and cement hoses are hooked up, and the system is pressure tested.

For the alternative embodiment utilized in sub sea cementing operations, the installation procedure is slightly varied, and one first picks up the handling sub and installs that with a crossover sub to the drill pipe connection, and then installs that to the stand of drill pipe. The next step is to make up the mandrel adaptor to the sub sea hanger system and stand back in the derrick. Either plug set, the inter-connected set or the set utilizing the restriction sleeve, can be used depending upon whether or not the lower plug is attached to the top plug.

The sub sea and conventional systems are launched in the same manner. The desired amount of casing is run, and the casing elevators are changed out for drill pipe elevators. The sub sea landing string is run and landed out, or the casing pump landing joint with the handling sub is run and landed out. The launching of the balls and picking up the bottom and top plug is achieved as described below:

The surface injection manifold is placed in position on the rig floor. The chicksan is connected from a cement manifold to the injection manifold. A high pressure hose is then attached from the outlet of the injection manifold to the casing handling sub circulating inlet. The system is then pressure tested. The system is circulated with the rig to the desired amount and the bottom plug pick up ball is released by attaching an air line from the rig air supply to the air cylinder of the bottom plug housing. The locking piston retracts allowing the launching piston rod to be forced down by its spring, thus pushing the bottom plug pick-up ball down into the manifold flow line. The fluid then carries the ball through hose past the magnetic sensor and into the lower plug and onto its ball stop. Additional pressure releases the lower plug, either by shearing its shear ring, or forcing it past the restrict sleeve, depending upon which embodiment is being utilized. After cement is mixed, the top plug is picked up in a similar manner by releasing its latching air cylinder, which in turn allows its injection piston rod to force its appropriately sized pick-up ball into the flow stream, past the magnetic sensor, and into the landing seat of the top plug.

The top plug or displacement plug is now displacing cement. When the bottom plug hits the float collar, additional pressure ruptures its rubber rupture disc allowing fluid to pass through the circulating ports within the float collar and the cement shoe, and on through the circulation ports in the shoe. As pressure is applied against the pistons within the float shoe and cement shoe, each piston is forced downward compressing the rubber spring and opening the flow ports, which establishes circulation through the float collar and float shoe.

To check or prevent "U tubing" or back flow of fluid or cement, the pump is stopped and the non-metallic spring forces the piston upward, covering the circulating ports and allowing a trouble free check arrangement, which no foreign manner can block, thereby preventing any leaks. The float collar and float shoe are run in the casing string with the float collar one or two joints above the float shoe.

In summary, the advantages presented by the improved float collar and float shoe arrangement described and disclosed herein are found by eliminating the ball check found in prior art designs, and using the piston arrangement support by the resilient rubber string. The body of the float collar or cement shoe is provided with a taper which mates with a corresponding taper provided on the plastic insert, which in the primary embodiment or injection, are modeled of a high density plastic improving loading characteristics for the float collar and float shoe. An additional feature of the float shoe is that the flow area port outlets are angled, for instance in the primary embodiment at 45° outward to improve jetting action if the casing is washed in for any reason. It is important to note that all internal parts of the float collar and float shoe are fabricated from plastic and rubber, and use no metal to insure the ease of drilling out.

To sum up the advantages of the entire method and apparatus of the present launching and injection system, it should be appreciated that the balls can be launched mechanically, thereby eliminating having to send personnel into the derrick to manually launch. In addition, the launching head is skid mounted with safety pistons to prevent and eliminate premature launching of either ball. The system of the present application can be utilized on any size casing, simply by changing out the adaptor bushing for each casing sizer thread type. The improved system of the present invention is adaptable to any existing sub C system simply by using a cross-over adaptor. The system described herein utilizes both top and bottom flex plugs to give a more positive seal against the wall of the casing, and in optional embodiments can be provided with more than two displacement plugs to run optional chemical spacer fluids if desired. The system of the present invention is installed inside the casing and therefore, requires no additional clearance above the casing for housings or plug installation. The flex plugs the primary embodiment are designed to eliminate wear on all sets of wiper wings simultaneously with only the upper most wing contacting the wall of the casing at any one time. When pressure is applied to the top wing it is forced down forcing the bottom wing out against the wall of the casing. The wiper wings below the top wiper wing are held away from the wall of the casing by applying pressure to the bottom of the wiper wing. For safety reasons, the plug containers of the prior art devices are dangerous and require personnel and a derrick to manually launch the dart in the ball. The plug monitor launching injection head of the present invention can be tested to pressures exceeding the internal yield of any casing string. The flex plug sets, comprising two or more flex plugs which may or not be interlocked by shear rings are fabricated entirely from high tensile plastic, polyurethanes and/or rubber to allow the plugs to be flexible but strong and to allow for the plugs to be easily drilled while drilling out with a rock bit or stratapack bit. The flex plugs utilized with the primarily embodiment of the present invention are so designed to add any amount of wiper wings to a plug set. In deep high angle holes where excessive wear is evident, additional wings sets can be added to accommodate wear. The flex plugs which are interlocked into flex plugs sets utilize plastic sheer rings instead of shear pins for reliability. The alternative embodiment which does not use interlocked sets of plugs utilizes the plastic restriction sleeve which allows the passage of only one flex plug at a time.

While the preferred embodiments of the invention have been described above, will be recognized and understood that various modifications may be made therein and the appended claims are intended to cover all such modifications which may fall with the spirit and scope of the invention.

Having described my invention with the particularity set forth above, what is claimed is:

1. An apparatus for injecting cement displacement plugs into a well bore for cementing casing comprising:
(a) a well bore casing with an upper inlet and a lower outlet;
(b) a manifold comprising a housing provided with an inlet and an outlet connected by a flow passage through the housing;
(c) at least one launching cylinder comprising a housing provided with an interior bore connected with said flow passage;
(d) a spring loaded injection piston mounted within said launching housing;
(e) pick up means for insertion into said interior bore;
(f) releasable retaining means for selectively releasing said pick up means;
(g) means for remote mounting of said manifold and means for connection of said manifold to said well bore; and,
(h) means for a remote actuation of said injection piston, and means for remote actuation of said retaining means.

2. The invention of claim 1 further comprising:
(a) a plug set of a plurality of displacement plugs each mounted to a central mandrel which is provided with an interior bore there-through connected in fluid communication with said flow passage and each provided with means for cooperation with said released pick up means to selectively launch said plugs;
(b) an inner adaptor ring which is connected to the plug set by a mandrel adaptor connected to the top of the central mandrel of the top plug;
(c) a casing adaptor for insertion into the pipe casing of the given diameter and for connection to said inner adaptor ring to thereby position the plug sets below the surface opening of the casing and within the interior bore of the casing to be cemented.

3. The invention of claim 2 wherein the plugs of the plug set are fixed to one another and aligned coaxially by a shear ring.

4. The invention of claim 2 wherein the plugs sets are not fixedly connected one to another but wherein a restriction sleeve is provided in the casing below the plug sets upon which the bottom plug will land and which thereby will prevent the passage of more than one displacement plug at a time.

5. The invention of claim 1 further comprising:
(a) a float collar connected to said upper inlet of said casing, said float collar comprising an annular body provided with a tapered interior bore;
(b) a tapered plastic insert shaped to conform to the corresponding tapered bore within said float collar, said insert provided with an interior bore and flow passages;
(c) a cap sealingly mounted to close the lower portion of said bore in said insert;
(d) a resilient non-metallic spring mounted upon the upper portion of said cap; and,
(e) a piston mounted upon said resilient non-metallic spring said piston positioned to close off said flow passages through said passage insert until sufficient pressure is applied to the surface of said piston to collapse said non-metallic spring and move the upper surface of aid piston down below the apertures of said flow passages and thereby permit fluid flow into the area between the float collar.

6. The invention of claim 1 further comprising:
(a) a cement shoe connected to said upper inlet of said casing, said cement shoe comprising an annular body provided with a tapered interior bore;
(b) a tapered plastic insert shaped to conform to the corresponding tapered bore within said cement shoe, said insert provided with an interior bore and flow passages;
(c) a cap sealingly mounted to close the lower portion of said bore in said insert;
(d) a resilient non-metallic spring mounted upon the upper portion of said cap; and,
(e) a piston mounted upon said resilient non-metallic spring said piston positioned to close off said flow passages through said passage insert until sufficient pressure is applied to the surface of said piston to collapse said non-metallic spring and move the upper surface of said piston down below the apertures of said flow passages and thereby permit fluid flow into the area between the cement shoe.

* * * * *